US009761168B2

(12) United States Patent
Wang et al.

(10) Patent No.: US 9,761,168 B2
(45) Date of Patent: Sep. 12, 2017

(54) DISPLAY PANEL, DISPLAY METHOD THEREOF, AS WELL AS DISPLAY DEVICE

(71) Applicants: Boe Technology Group Co., Ltd., Beijing (CN); Beijing Boe Optoelectronics Technology Co., Ltd., Beijing (CN)

(72) Inventors: Kaixuan Wang, Beijing (CN); Hongliang Yuan, Beijing (CN); Wei Li, Beijing (CN); Jiantao Liu, Beijing (CN); Zhenfu Ma, Beijing (CN); Yingzi Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/122,618

(22) PCT Filed: Jul. 21, 2015

(86) PCT No.: PCT/CN2015/084676

§ 371 (c)(1),
(2) Date: Aug. 30, 2016

(87) PCT Pub. No.: WO2016/169143

PCT Pub. Date: Oct. 27, 2016

(65) Prior Publication Data

US 2017/0069250 A1 Mar. 9, 2017

(30) Foreign Application Priority Data

Apr. 20, 2015 (CN) ..... 2015 1 0187983

(51) Int. Cl.
*G09G 3/20* (2006.01)

(52) U.S. Cl.
CPC ..... *G09G 3/2074* (2013.01); *G09G 3/20* (2013.01); *G09G 3/2003* (2013.01);
(Continued)

(58) Field of Classification Search
CPC ..... G09G 3/2074; G09G 3/20; G09G 3/2003; G09G 2300/0452; G09G 2320/0646;
(Continued)

(56) References Cited

U.S. PATENT DOCUMENTS

2007/0052735 A1* 3/2007 Chou ..... H04N 17/04 345/690
2009/0213048 A1* 8/2009 Park ..... G09G 3/2003 345/77

(Continued)

FOREIGN PATENT DOCUMENTS

CN 101236720 A 8/2008
CN 102622981 A 8/2012

(Continued)

OTHER PUBLICATIONS

International Search Report and Written Opinion in PCT/CN2015/084676 dated Jan. 26, 2016, with English translation. 15 pages.

(Continued)

*Primary Examiner* — Kent Chang
*Assistant Examiner* — Sujit Shah
(74) *Attorney, Agent, or Firm* — Blakely Sokoloff Taylor & Zafman LLP

(57) ABSTRACT

The disclosure relates to a display panel, a display method thereof and a display device. The method comprises: confirming a received image to be displayed as a preset pure-colored image; for each of the green subpixels, comparing the grayscale value that the green subpixel corresponds to with that of the red subpixel or the blue subpixel at a place corresponding to the green subpixel in a previous row to find out the difference; and adjusting the grayscale value of the green subpixel for displaying based on the difference. The grayscale value of the green subpixel is increased or decreased by a preset value according to whether the difference is greater than 0. Thereby the charging capacities of all the green subpixels are substantially the same, so as to avoid brightness difference and eliminate light and dark stripes appearing in the display panels.

15 Claims, 7 Drawing Sheets

(52) U.S. Cl.
CPC ..... *G09G 2300/0452* (2013.01); *G09G 2320/0646* (2013.01); *G09G 2320/0673* (2013.01)

(58) Field of Classification Search
CPC ... G09G 2320/0673; G09G 2300/0443; G09G 2340/0457; G09G 3/2018; G09G 3/2022; G09G 3/3208
See application file for complete search history.

(56) References Cited

U.S. PATENT DOCUMENTS

2009/0219306 A1* 9/2009 Oh ..... G09G 3/3225 345/690
2009/0225105 A1* 9/2009 Park ..... G09G 3/3688 345/690
2011/0254759 A1* 10/2011 Mori ..... G09G 3/3607 345/88
2015/0049123 A1* 2/2015 Choi ..... G09G 3/2003 345/690

FOREIGN PATENT DOCUMENTS

| | | | |
|---|---|---|---|
| CN | 103050076 | A | 4/2013 |
| CN | 103280187 | A | 9/2013 |
| CN | 103745688 | A | 4/2014 |
| CN | 104751767 | A | 7/2015 |
| EP | 2639785 | A2 | 9/2013 |
| WO | WO 2013159508 | A1 | 10/2013 |

OTHER PUBLICATIONS

Office Action in Chinese Application No. 201510187983.9 dated Dec. 2, 2016, with English translation. 6 pages.

* cited by examiner

DISPLAY PANEL, DISPLAY METHOD THEREOF, AS WELL AS DISPLAY DEVICE

RELATED APPLICATIONS

The present application is the U.S. national phase entry of PCT/CN2015/084676 with an International filing date of Jul. 21, 2015, which claims the benefit of Chinese Application No. 201510187983.9, filed on Apr. 20, 2015, the entire disclosures of which are incorporated herein by reference.

TECHNICAL FIELD

The present disclosure relates to the field of display technology, and more particularly to a display panel, a display method thereof and a display device.

BACKGROUND

In a typical LCD device or an OLED device, each point (pixel) has its colour shown in the form of a mixed light by a plurality of subpixels. For instance, each pixel is composed of a red subpixel, a green subpixel and a blue subpixel (RGB mode).

To improve visual effects, people set higher and higher requirements for resolution (the number of pixels per unit of measurement) of display devices. The size of subpixels is required to be smaller, but cannot be reduced infinitely due to the process limitations.

SUMMARY

To this end, some embodiments provide a display panel, a display method thereof and a display device so as to eliminate light and dark stripes appearing in a display panel arranged in a Rainbow manner when showing a pure coloured image, thereby improving the image effect of display panels.

According to one aspect, there is provided a display method of a display panel comprising a plurality of red subpixels, green subpixels and blue subpixels that are all arranged in a Rainbow manner, which display method comprises the steps of:

confirming a received image to be displayed as a preset pure-coloured image, in which the grayscale values that the green subpixels correspond to are within a preset range whereas the grayscale values that the red subpixels and the blue subpixels correspond to are respectively located at different sides beyond the preset range;

for each of the green subpixels, comparing the grayscale value that the green subpixel corresponds to with that of the red subpixel or the blue subpixel at a place corresponding to the green subpixel in a previous row to find out the difference; and adjusting the grayscale value of the green subpixel for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0.

Optionally, in the display method provided by the above embodiment, the preset value is positively correlated to the absolute value of the difference between the grayscale value that the red subpixel corresponds to and the grayscale value that the blue subpixel corresponds to.

Optionally, in the display method provided by the above embodiment, the preset value is greater than 0 and less than or equal to 2.

Optionally, in the display method provided by the above embodiment, when, in the image to be displayed, the grayscale value that the red subpixel corresponds to is 0 or 255, the grayscale value that the blue subpixel corresponds to is 255 or 0 and the grayscale value that the green subpixel corresponds to is 127, the preset value is equal to 2.

Optionally, in the display method provided by the above embodiment, the preset range is from 100 to 150.

Optionally, in the display method provided by the above embodiment, before confirming a received image to be displayed as a preset pure-coloured image, the display method further comprises the step of receiving grayscale information of a frame of the image to be displayed, and confirming whether the image to be displayed is a preset pure-coloured image according to the grayscale information.

Optionally, in the display method provided by the above embodiment, when it is confirmed that the received image to be displayed is not the preset pure-coloured image, the image is displayed according to the grayscale information of the received image to be displayed.

Optionally, in the display method provided by the above embodiment, when it is confirmed that the received image to be displayed is the preset pure-coloured image, the red subpixels and the blue subpixels are displayed respectively according to the grayscale value that the red subpixels correspond to and the grayscale value that the blue subpixels correspond to in the grayscale information of the received image to be displayed.

Correspondingly, some embodiments also provide a display panel comprising a plurality of red, green and blue subpixels that are arranged in a Rainbow manner, and further a source driver connected with data lines of the display panel, wherein the source driver comprises:

a confirmation unit configured for confirming a received image to be displayed as a preset pure-coloured image, in which the grayscale values that the green subpixels correspond to are within a preset range whereas the grayscale values that the red subpixels and the blue subpixels correspond to are respectively located at different sides beyond the preset range;

a comparison unit configured for comparing the grayscale value that the green subpixel corresponds to with that of the red subpixel or the blue subpixel at a place corresponding to the green subpixel in a previous row to find out the difference; and a display unit configured for adjusting the grayscale value of the green subpixel for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0.

Optionally, in the display panel provided by the above embodiment, the preset value is positively correlated to the absolute value of the difference between the grayscale value that the red subpixel corresponds to and the grayscale value that the blue subpixel corresponds to.

Optionally, in the display panel provided by the above embodiment, the preset value is greater than 0 and less than or equal to 2.

Optionally, in the display panel provided by the above embodiment, when, in the image to be displayed, the grayscale value that the red subpixel corresponds to is 0 or 255, the grayscale value that the blue subpixel corresponds to is 255 or 0 and the grayscale value that the green subpixel corresponds to is 127, the preset value is equal to 2.

Optionally, in the display panel provided by the above embodiment, the preset range is from 100 to 150.

Optionally, the display panel provided by the above embodiment further comprises:

a receiving unit configured for receiving grayscale information of a frame of the image to be displayed before confirming a received image to be displayed as a preset pure-coloured image, and confirming whether the image to be displayed is the preset pure-coloured image according to the grayscale information.

Optionally, in the display panel provided by the above embodiment, the display unit is also configured to display an image according to the grayscale information of the received image to be displayed when the received image to be displayed is not the preset pure-coloured image.

Optionally, in the display panel provided by the above embodiment, the display unit is also configured to display the red subpixels and the blue subpixels respectively according to the grayscale value that the red subpixels correspond to and the grayscale value that the blue subpixels correspond to in the grayscale information of the received image to be displayed, when it is confirmed that the received image to be displayed is the preset pure-coloured image.

Correspondingly, the embodiments also provide a display device comprising any of the display panels provided by the above embodiments.

In the display panel, the display method thereof and the display device provided by the embodiments, a received image to be displayed is confirmed as a preset pure-coloured image; for each of the green subpixels, the grayscale value that the green subpixel corresponds to is compared with that of the red subpixel or the blue subpixel located at a place corresponding to the green subpixel in a previous row to find out the difference; and the grayscale value of the green subpixel is adjusted for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0. The charging capacities of all the green subpixels are substantially the same, so as to avoid brightness differences and eliminate light and dark stripes appearing in the display panels.

DETAILED DESCRIPTION

Figure 1:
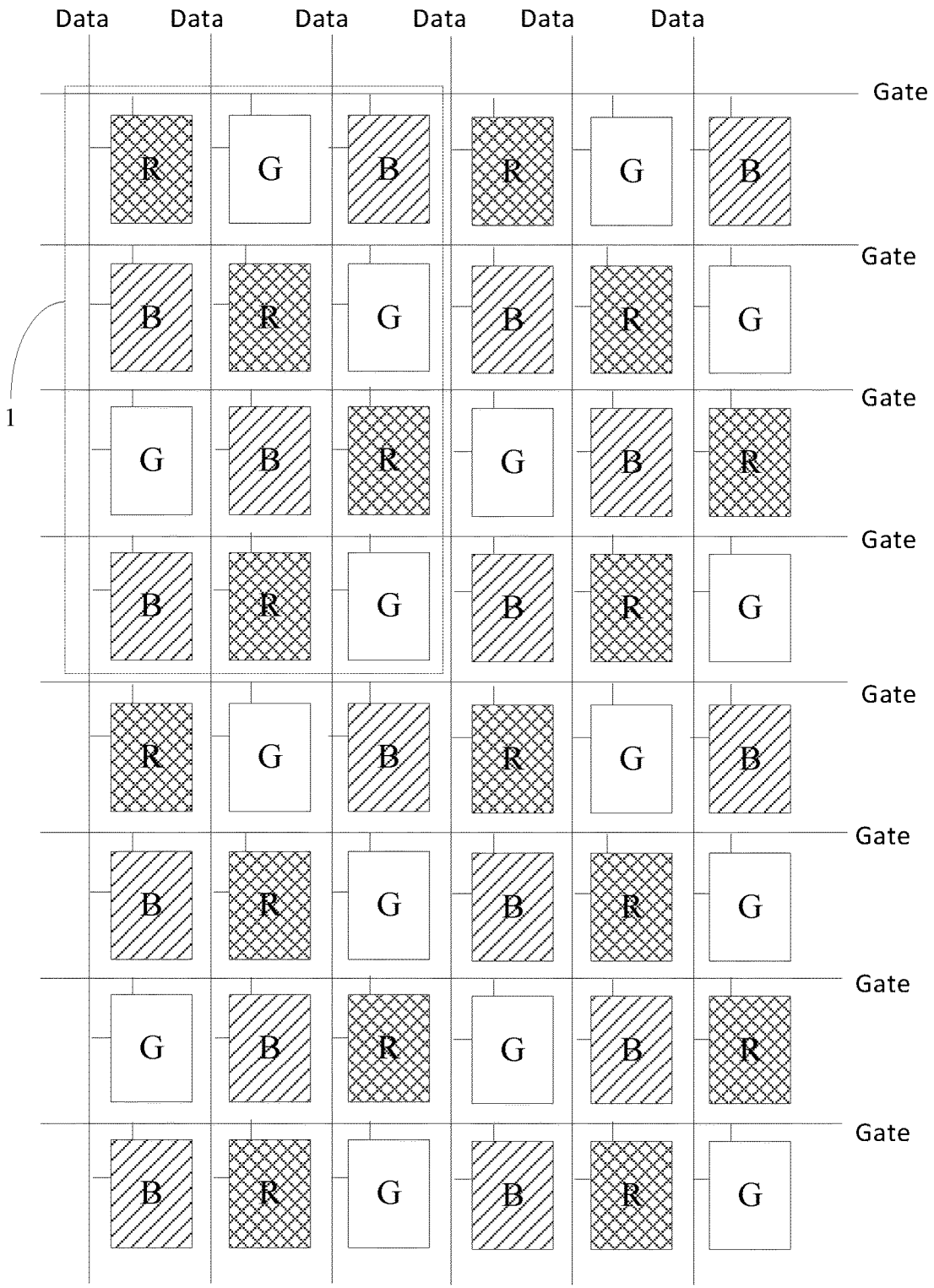
FIG. 1 is a specific structural schematic view of an existing display panel arranged in a Rainbow manner.

To improve display effects with the size of subpixels being constant, people propose a virtual display design with a Rainbow arrangement. In the design, RGB (Red Green Blue) subpixels are arranged in a Rainbow manner. As shown in FIG. 1, a display panel comprises multiple matrix arranged pixel groups 1 composed of a plurality of subpixels, gate lines Gate connected with subpixel rows and data lines Data connected with the subpixel columns. Each pixel group 1 comprises 4×3 subpixels. In each pixel group, from top to bottom, a first row is a red subpixel R, a green subpixel G and a blue subpixel B; a second row is a blue subpixel B, a red subpixel R and a green subpixel G; a third row is a green subpixel G, a blue subpixel B and a red subpixel R; and a fourth row is a blue subpixel B, a red subpixel R and a green subpxiel G. In comparison with the conventional display panel, the above virtually designed display panel reduces 1/3 subpixels, but can still achieve the same display effect through such a special Rainbow arrangement and corresponding virtual algorithms.

Different from the conventional display panel, the virtual display panel above has the same data line Data connected with three different-coloured subpixels (red, green, blue). Thus, when a pure-coloured image (namely, the grayscale values of red, green and blue are constant) is displayed, the corresponding subpixel in the row above a green subpixel G may be a red subpixel R or a blue subpixel B. When the grayscale value of R is different from that of B, for example, R=0, G=127, B=255 or R=255, G=127, B=0, the grayscale value 127 of the green subpixels G may be jumped from 0 in the previous row, or from 255 in the previous row. Although the grayscale value of the green subpixels G finally becomes 127, the jump from 255 to 127 actually charges more electricity to the green subpixels G than the jump from 0 to 127, which results in that the green subpixels G jumped from 255 to 127 are brighter than the green subpixels G jumped from 0 to 127, thereby leading to light and dark stripes visually that affect the display effect of the display panel.

Figure 2:
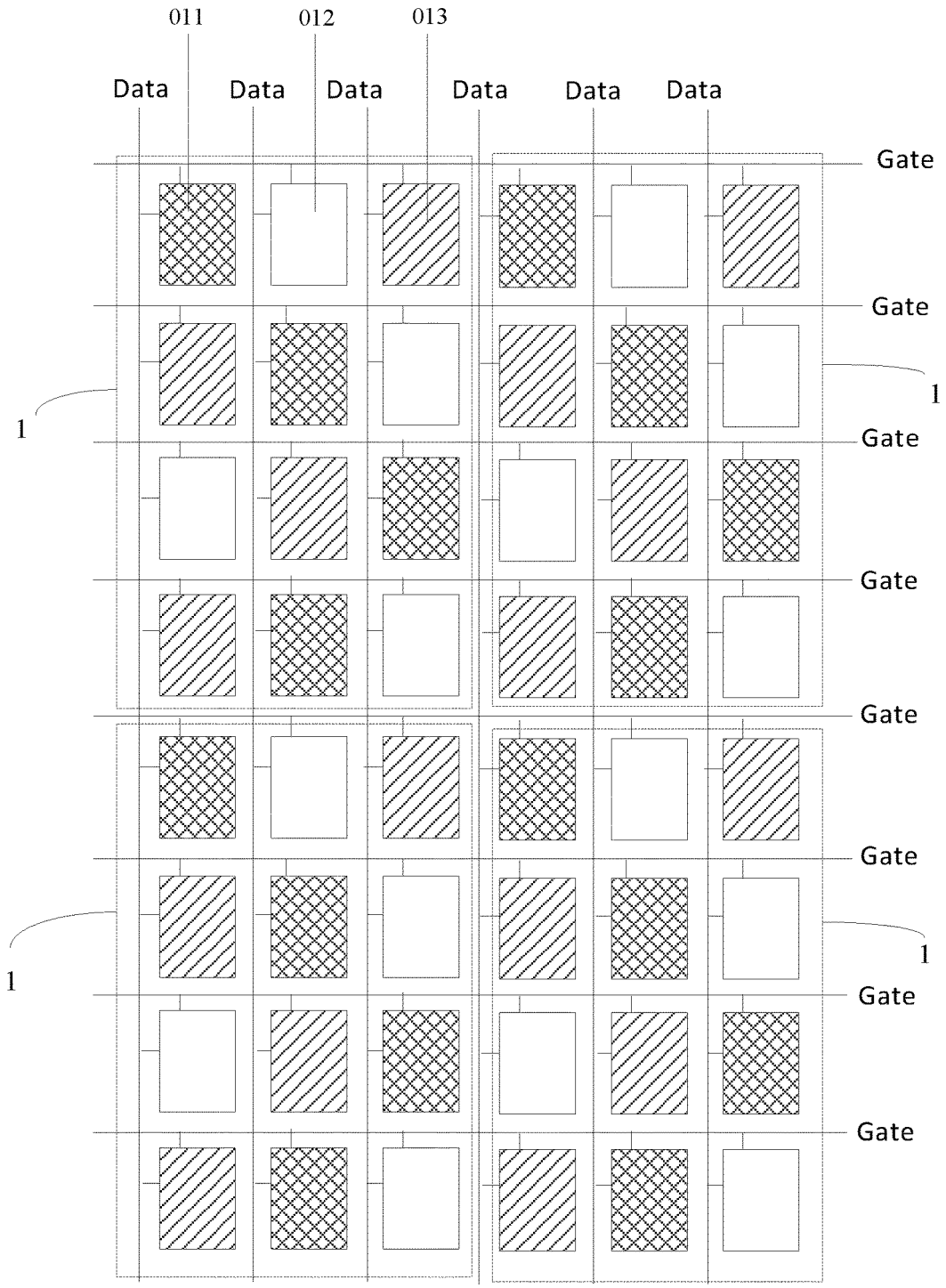
FIG. 2 is a structural schematic view of a display panel arranged in a Rainbow manner.

A visual display panel with a Rainbow arrangement, as shown in FIG. 2, comprises multiple matrix arranged pixel groups 1 composed of a plurality of subpixels, data lines Data connected with subpixel columns in a one-to-one relationship and gate lines Gate connected with the subpixel rows in a one-to-one relationship. Each pixel group 1 comprises 4×3 subpixels. The first subpixel row is respectively a first subpixel 011, a second subpixel 012 and a third subpixel 013, the second subpixel row is respectively the third subpixel 013, the first subpixel 011 and the second subpixel 012, the third subpixel row is respectively the second subpixel 012, the third subpixel 013 and the first subpixel 011, and the fourth subpixel row is respectively the third subpixel 013, the first subpixel 011 and the second subpixel 012. The colour of the first subpixel 011, the second subpixel 012 and the third subpixel 013 may be respectively one of red, green and blue.

In the above display panel with the Rainbow arrangement, the same data line Data is connected with three different-coloured subpixels (red subpixel, green subpixel, blue subpixel). Thus, when a pure-coloured image (namely, the grayscale values that red, green and blue subpixels correspond to are constant) is displayed, the corresponding subpixel in the row above a green subpixel may be a red subpixel or a blue subpixel. When the grayscale value of the red subpixel is different from that of the blue subpixel, for example, the grayscale value of the red subpixel is 0, the grayscale value of the green subpixel is 127, the grayscale value of the blue subpixel is 255, or the grayscale value of the red subpixel is 255, the grayscale value of the green subpixel is 127, the grayscale value of the blue subpixel is 0, the grayscale value 127 of the green subpixel may be jumped from 0 in the previous row, or from 255 in the previous row. Although the grayscale value of all green subpixels finally becomes 127, the jump from 255 to 127 actually charges more electricity to the green subpixels than the jump from 0 to 127, which results in that the green subpixels jumped from 255 to 127 are brighter than the green subpixels jumped from 0 to 127, thereby leading to light and dark stripes visually that affect the display effect of the display panel.

It is based on the display panel with the Rainbow arrangement that the embodiment proposes a display method that eliminates light and dark stripes appearing when a pure-coloured image is displayed. The specific implementations of the display panel, the display method thereof and the display device provided by the embodiments will be described in detail with reference to the drawings.

Figure 3:
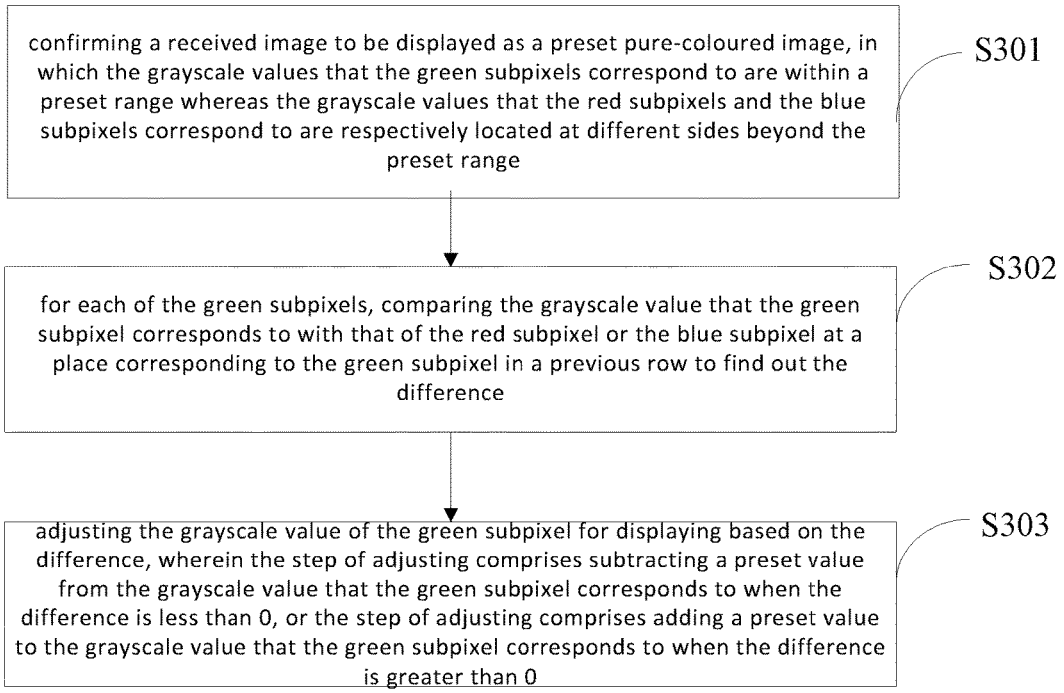
FIG. 3 is a flowchart illustrating a display method of the display panel provided by an embodiment.

FIG. 3 illustrates a display method of the display panel provided by an embodiment. The display panel, as shown in FIG. 2, comprises a plurality of red, green and blue subpixels that are arranged in a Rainbow manner. The display method may comprise the steps of:

S301: confirming a received image to be displayed as a preset pure-coloured image, in which the grayscale values that the green subpixels correspond to are within a preset range whereas the grayscale values that the red subpixels and the blue subpixels correspond to are respectively located at different sides beyond the preset range;

S302: for each of the green subpixels, comparing the grayscale value that the green subpixel corresponds to with that of the red subpixel or the blue subpixel located at a place corresponding to the green subpixel in a previous row to find out the difference; and

S303: adjusting the grayscale value of the green subpixel for displaying based on the difference. According to one embodiment, the step of adjusting comprises subtracting a preset value that is less than 5 from the grayscale value that the green subpixel corresponds to when the difference is less than 0. Or, according to another embodiment, the step of adjusting comprises adding a preset value that is less than 5 to the grayscale value that the green subpixel corresponds to when the difference is greater than 0.

It is to be explained that the pure-coloured image herein refers to an image whose red, green and blue subpixels correspond to a constant grayscale value respectively. That the grayscale values that the red subpixels and the blue subpixels correspond to are respectively located at different sides beyond the preset range means that the grayscale values that the red subpixels and the blue subpixels correspond to are respectively beyond the preset range, and the grayscale value of one of the red subpixels and the blue subpixels is greater than the maximum value of the preset range, while the grayscale value of the other is less than the minimum value of the preset value.

In the display panel with the Rainbow arrangement, green is a colour that human eyes are sensitive to. When an image is displayed by the prior display method, there may be a jump of the grayscale value that the green subpixels correspond to, namely the grayscale value that the red subpixels correspond to is greater than the grayscale value that the green subpixels correspond to, and the grayscale value that the blue subpixels correspond to is less than the grayscale value that the green subpixels correspond to, or the grayscale value that the red subpixels correspond to is less than the grayscale value that the green subpixels correspond to, and the grayscale value that the blue subpixels correspond to is greater than the grayscale value that the green subpixels correspond to. The grayscale value for a portion of the green subpixels is jumped from a greater grayscale value, and the grayscale value for the other portion of the green subpixels is jumped from a smaller grayscale value, so the green subpixels whose grayscale value is jumped from a greater grayscale value have a higher charging capacity and accordingly a higher brightness, and the green subpixels whose grayscale value is jumped from a smaller grayscale value have a lower charging capacity and accordingly a lower brightness, which explain the reason why light and dark stripes appear in the image.

Thus, according to the display method provided by the above embodiment, a received image to be displayed is confirmed as a preset pure-coloured image; for each of the green subpixels, the grayscale value that the green subpixel corresponds to is compared with that of the red subpixel or the blue subpixel at a place corresponding to the green subpixel in a previous row to find out the difference; and the grayscale value of the green subpixel is adjusted for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0. The charging capacities of all the green subpixels are substantially the same, so as to avoid brightness difference and eliminate light and dark stripes appearing in the display panels.

Optionally, in the display method provided by the above embodiment, the preset value is positively correlated to the absolute value of the difference between the grayscale value that the red subpixels correspond to and the grayscale value that the blue subpixels correspond to. Namely, the larger the absolute value of the difference between the grayscale value that the red subpixels correspond to and the grayscale value that the blue subpixels correspond to is, the larger the preset value is. As the absolute value of the difference between the grayscale value that the red subpixels correspond to and the grayscale value that the blue subpixels correspond to becomes larger, the light and dark stripes turn to be more apparent, and the grayscale value of the green subpixels needs more compensation.

Optionally, in the display method provided by the above embodiment, the preset value is greater than 0 and less than or equal to 2. The underlying reason is that, if the preset value is greater than 2, the resultant change of the chroma will be discernable to human eyes.

For instance, in the display method provided by the above embodiment, when, in the image to be displayed, the grayscale value that the red subpixels correspond to is 0 or 255, the grayscale value that the blue subpixels correspond to is 255 or 0 and the grayscale value that the green subpixels correspond to is 127, the light and dark stripes are the most apparent. Thus, the preset value can be selected to be a larger number, e.g., the preset value is selected to be equal to 2.

Optionally, in the display method provided by the above embodiment, the preset range of the green subpixels is from 100 to 150 because when the grayscale value that the green subpixels correspond to is less than 100 or greater than 150, such light and dark stripes are substantially not discernible to human eyes notwithstanding the grayscale jump.

Furthermore, in the display method provided by the above embodiment, before the step S301 of confirming a received image to be displayed as a preset pure-coloured image, the display method further comprises the step of receiving grayscale information of a frame of the image to be displayed, and confirming whether the image to be displayed is a preset pure-coloured image according to the grayscale information.

Furthermore, in the display method provided by the above embodiment, when it is confirmed that the received image to be displayed is not the preset pure-coloured image, the image is displayed according to the grayscale information of the received image to be displayed.

Moreover, in the display method provided by the above embodiment, when it is confirmed that the received image to be displayed is the preset pure-coloured image, the red subpixels and the blue subpixels are displayed respectively according to the grayscale value that the red subpixels correspond to and the grayscale value that the blue subpixels correspond to in the grayscale information of the received image to be displayed.

The display method of the display panel provided by the above embodiment will be explained by the following specific example.

Figure 4A:
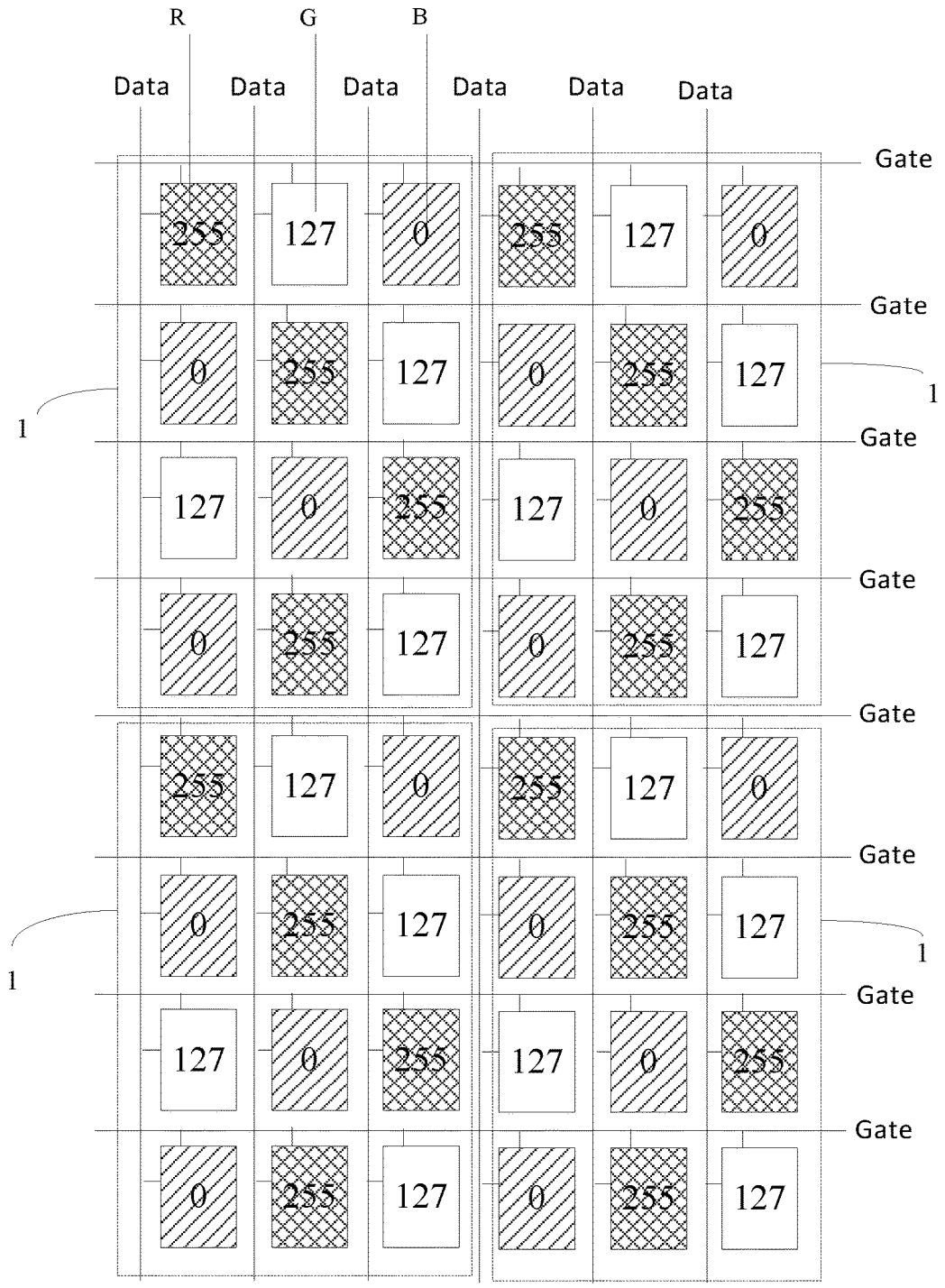
FIG. 4*a* is a schematic view of corresponding initial grayscale information when the display panel provided by an embodiment is displaying a preset pure-coloured image.

As shown in FIG. 4*a*, suppose the first subpixel 011 is a red subpixel R, the second subpixel 012 is a green subpixel G, and the third subpixel 013 is a blue subpixel B. Suppose, in the grayscale information of the received image to be displayed, the grayscale value that the green subpixel G corresponds to is 127, the grayscale value that the red subpixel R corresponds to is 255 and the grayscale value that the blue subpixel B corresponds to is 0, i.e., G=127, R=255, B=0. It can be determined from the grayscale information that the image to be displayed is a preset pure-coloured image. As shown in FIG. 4*a*, the grayscale value 127 of the green subpixels G in lines 2, 3, 6 and 7 is jumped from 0 in the previous row, and the grayscale value 127 of the green subpixels G in lines 4, 5 and 8 is jumped from 255 in the previous row. If the subpixels are displayed according to the original grayscale information G=127, the green subpixels in lines 2, 3, 6 and 7 have less charging capacities and accordingly lower brightness, and the green subpixels G in lines 4, 5 and 8 have more charging capacities and accordingly higher brightness.

Figure 4B:
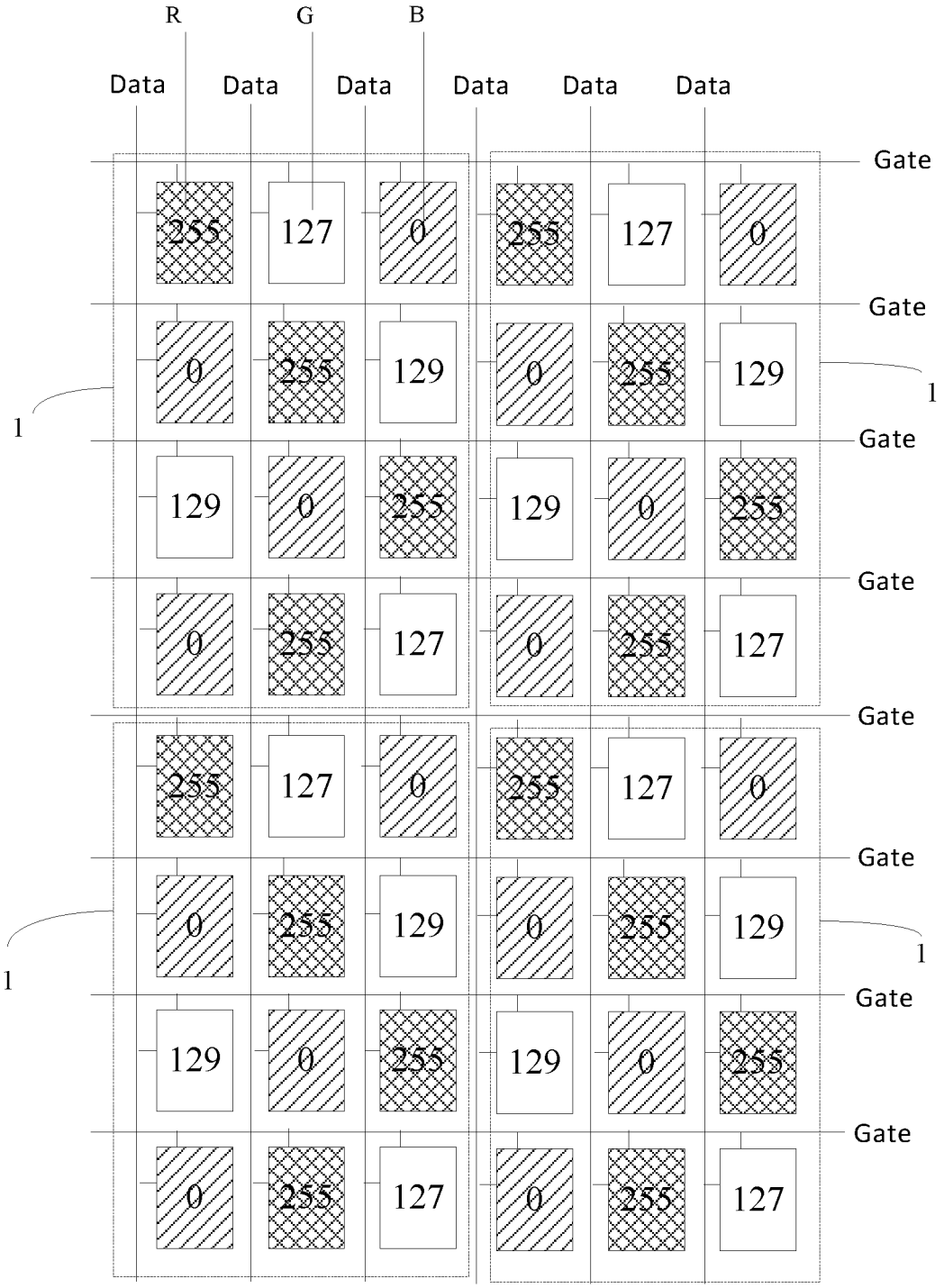
FIG. 4*b* is a first schematic view of corresponding targeted grayscale information when the display panel provided by an embodiment is displaying a preset pure-coloured image.
Figure 4C:
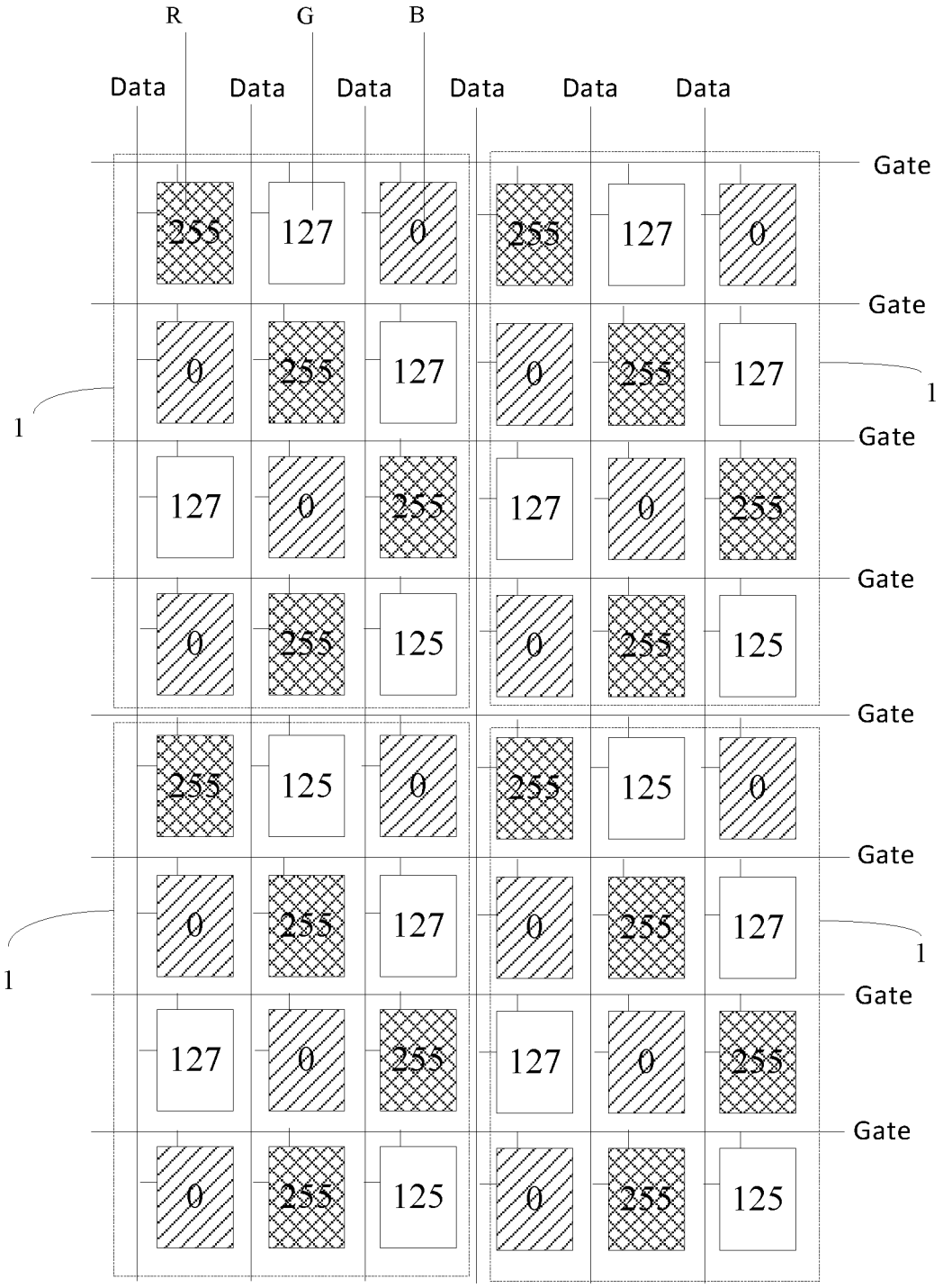
FIG. 4*c* is a second schematic view of corresponding targeted grayscale information when the display panel provided by an embodiment is displaying a preset pure-coloured image.

According to one embodiment, the grayscale value of the green subpixels can be adjusted according to the difference between the grayscale value of the green subpixels and the grayscale value of the blue or red subpixels at the corresponding place in the previous row. As shown in FIG. 4*b*, 2 can be added to the grayscale value 127 of the green subpixels G in lines 2, 3, 6 and 7 to obtain targeted grayscale information. Although the grayscale value of the green subpixels G in lines 2, 3, 6 and 7 is 129 in the targeted grayscale information, these green subpixels have the same charging capacities as that of the green subpixels G in lines 4, 5 and 8 with the grayscale value 127, thereby avoiding difference in brightness and eliminating light and dark stripes. Or, as shown in FIG. 4*c*, 2 can be subtracted from the grayscale value 127 of the green subpixels G in lines 4, 5 and 8 to obtain targeted grayscale information. Although the grayscale value of the green subpixels G in lines 4, 5 and 8 is 125 in the targeted grayscale information, these green subpixels have the same charging capacitance as that of the green subpixels G in lines 2, 3, 6 and 7 with the grayscale value 127, thereby avoiding difference in brightness and eliminating light and dark stripes.

Figure 5:
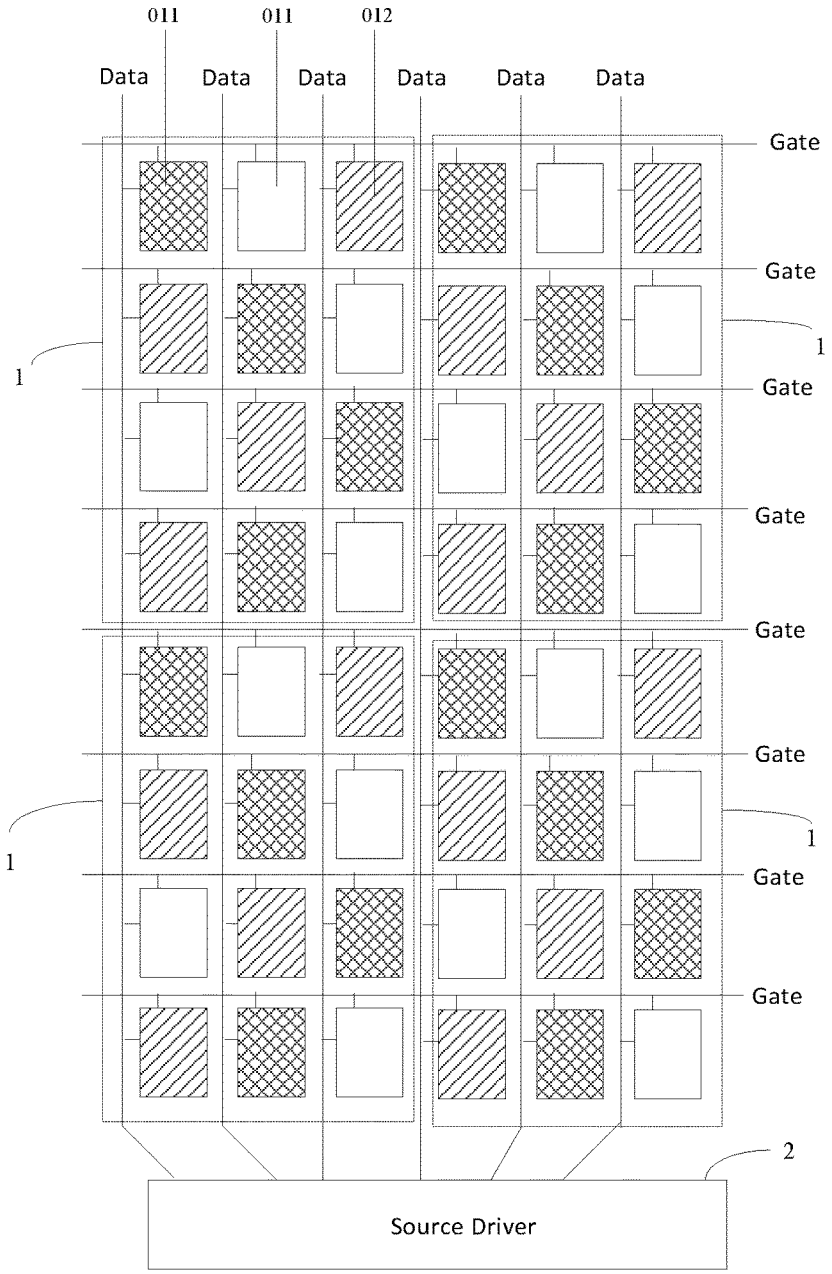
FIG. 5 is a structural schematic view of a display panel provided by an embodiment.
Figure 6:
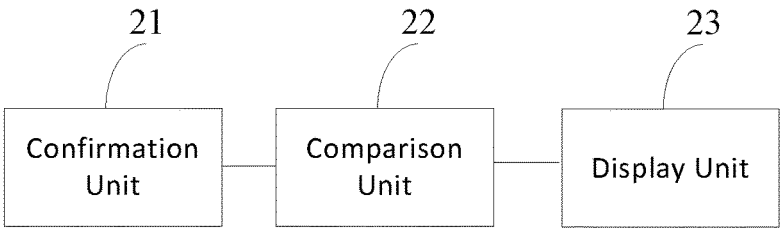
FIG. 6 is a structural schematic view of a source driver provided by an embodiment.

Based on the same invention concept, the embodiments also provide a display panel, which comprises, as shown in FIG. 5, a plurality of red, green and blue subpixels that are arranged in a Rainbow manner, and further a source driver 2 connected with data lines Data of the display panel, wherein, as shown in FIG. 6, the source driver 2 comprises:

a confirmation unit 21 configured for confirming a received image to be displayed as a preset pure-coloured image, in which the grayscale values that the green subpixels correspond to are within a preset range whereas the grayscale values that the red subpixels and the blue subpixels correspond to are respectively located at different sides beyond the preset range;

a comparison unit 22 configured for comparing the grayscale value that a green subpixel corresponds to with that of the red subpixel or the blue subpixel at a place corresponding to the green subpixel in a previous row to find out the difference; and a display unit 23 configured for adjusting the grayscale value of the green subpixel for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0.

In the display panel provided by the above embodiment, the source driver confirms a received image to be displayed as a preset pure-coloured image; for each of the green subpixels, it compares the grayscale value that the green subpixel corresponds to with that of the red subpixel or the blue subpixel at a place corresponding to the green subpixel in a previous row to find out the difference; and it adjusts the grayscale value of the green subpixel for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0. The charging capacities of all the green subpixels are substantially the same, so as to avoid brightness difference and eliminate light and dark stripes appearing in the display panels.

Optionally, in the display panel provided by the above embodiment, the preset value is positively correlated to the absolute value of the difference between the grayscale value that the red subpixels correspond to and the grayscale value that the blue subpixels correspond to. Namely, the larger the absolute value of the difference between the grayscale value that the red subpixels correspond to and the grayscale value that the blue subpixels correspond to is, the larger the preset value is. As the absolute value of the difference between the grayscale value that the red subpixels correspond to and the grayscale value that the blue subpixels correspond to becomes larger, the light and dark stripes turn to be more apparent, and the grayscale value of the green subpixels needs more compensation.

Optionally, in the display panel provided by the above embodiment, the preset value is greater than 0 and less than or equal to 2. The underlying reason is that, if the preset value is greater than 2, the resultant change of chroma is discernable to human eyes.

Optionally, in the display panel provided by the above embodiment, when, in the image to be displayed, the grayscale value that the red subpixels correspond to is 0 or 255, the grayscale value that the blue subpixels correspond to is 255 or 0 and the grayscale value that the green subpixels correspond to is 127, the light and dark stripes are the most apparent. Thus, the preset value can be selected to be larger, e.g., the preset value is selected to be equal to 2.

Optionally, in the display panel provided by the above embodiment, the preset range is from 100 to 150, because when the grayscale value that the green subpixels correspond to is less than 100 or greater than 150, such light and dark stripes are substantially not discernible to human eyes notwithstanding grayscale jump.

Optionally, the display panel provided by the above embodiment further comprises: a receiving unit configured for receiving grayscale information of a frame of the image to be displayed before confirming a received image to be displayed as a preset pure-coloured image, and confirming whether the image to be displayed is the preset pure-coloured image according to the grayscale information.

Optionally, in the display panel provided by the above embodiment, the display unit is also configured to display an image according to the grayscale information of the received image to be displayed when the received image to be displayed is not the preset pure-coloured image.

Optionally, in the display panel provided by the above embodiment, the display unit is also configured to display the red subpixels and the blue subpixels respectively according to the grayscale value that the red subpixels correspond to and the grayscale value that the blue subpixels correspond to in the grayscale information of the received image to be displayed, when it is confirmed that the received image to be displayed is the preset pure-coloured image.

Based on the same invention concept, the embodiments also provide a display device comprising the display panel provided by the above embodiments. Since the display device is similar to the display panel as stated above in terms of the problem-solving principle, please refer to the implementation of the display panel for the implementation of the display device, which will not be reiterated.

To be specific, the display device provided by the embodiments may be any product or component that has a display function, such as cell phones, tablets, TVs, displays, laptops, digital frames, and navigation devices, which will not be limited herein.

In the display panel, the display method thereof and the display device as provided by the above embodiments, a received image to be displayed is confirmed as a preset pure-coloured image; for each of the green subpixels, the grayscale value that the green subpixel corresponds to is compared with that of the red subpixel or the blue subpixel at a place corresponding to the green subpixel in a previous row to find out the difference; and the grayscale value of the green subpixel is adjusted for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0. The charging capacities of all the green subpixels are substantially the same, so as to avoid brightness difference and eliminate light and dark stripes appearing in the display panels.

It is clear that those skilled in the art can make various modifications and variations to the present invention without departing from the spirit and scope of the present invention. Thus, if those modifications and variations fall within the scope of the claims of the present invention and the equivalent techniques thereof, the present invention is intended to include those modifications and variations.

The invention claimed is:

1. A display method of a display panel comprising a plurality of red subpixels, green subpixels and blue subpixels that are arranged in a Rainbow manner, wherein the display method comprises the steps of:

confirming a received image to be displayed as a preset pure-coloured image, in which the grayscale values that the green subpixels correspond to are within a preset range whereas the grayscale values that the red subpixels and the blue subpixels correspond to are respectively located at different sides beyond the preset range;

for each of the green subpixels, comparing the grayscale value that the green subpixel corresponds to with that of the red subpixel or the blue subpixel at a place corresponding to the green subpixel in a previous row to find out the difference; and adjusting the grayscale value of the green subpixel for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0.

2. The display method according to claim 1, wherein the preset value is positively correlated to the absolute value of the difference between the grayscale value that the red subpixels correspond to and the grayscale value that the blue subpixels correspond to.

3. The display method according to claim 2, wherein the preset value is greater than 0 and less than or equal to 2.

4. The display method according to claim 3, wherein when, in the image to be displayed, the grayscale value that the red subpixels correspond to is 0 or 255, the grayscale value that the blue subpixels correspond to is 255 or 0 and the grayscale value that the green subpixels correspond to is 127, the preset value is equal to 2.

5. The display method according to claim 1, wherein the preset range is from 100 to 150.

6. The display method according to claim 1, wherein, before confirming a received image to be displayed as a preset pure-coloured image, the display method further comprises the step of receiving grayscale information of a frame of the image to be displayed, and confirming whether the image to be displayed is a preset pure-coloured image according to the grayscale information.

7. The display method according to claim 6, wherein when it is confirmed that the received image to be displayed is not the preset pure-coloured image, the image is displayed according to the grayscale information of the received image to be displayed.

8. The display method according to claim 6, wherein when it is confirmed that the received image to be displayed is the preset pure-coloured image, the red subpixels and the blue subpixels are displayed respectively according to the grayscale value that the red subpixels correspond to and the grayscale value that the blue subpixels correspond to in the grayscale information of the received image to be displayed.

9. A display panel comprising a plurality of red, green and blue subpixels that are arranged in a Rainbow manner, the display panel further comprises a source driver connected with data lines of the display panel, wherein the source driver comprises:

a confirmation unit configured for confirming a received image to be displayed as a preset pure-coloured image, in which the grayscale values that the green subpixels correspond to are within a preset range whereas the grayscale values that the red subpixels and the blue subpixels correspond to are respectively located at different sides beyond the preset range;

a comparison unit configured for comparing the grayscale value that the green subpixel corresponds to with that of the red subpixel or the blue subpixel at a place corresponding to the green subpixel in a previous row to find out the difference; and a display unit configured for adjusting the grayscale value of the green subpixel for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0.

10. The display panel according to claim 9, wherein the preset value is positively correlated to the absolute value of the difference between the grayscale value that the red subpixels correspond to and the grayscale value that the blue subpixels correspond to.

11. The display panel according to claim 10, wherein the preset value is greater than 0 and less than or equal to 2.

12. The display panel according to claim 11, wherein, when, in the image to be displayed, the grayscale value that the red subpixels correspond to is 0 or 255, the grayscale value that the blue subpixels correspond to is 255 or 0 and the grayscale value that the green subpixels correspond to is 127, the preset value is equal to 2.

13. The display panel according to claim 9, wherein the preset range is from 100 to 150.

14. The display panel according to claim 9, further comprising:

a receiving unit configured for receiving grayscale information of a frame of the image to be displayed before confirming a received image to be displayed as a preset pure-coloured image, and confirming whether the image to be displayed is the preset pure-coloured image according to the grayscale information.

15. A display device, comprising a display panel wherein the display panel comprises a plurality of red, green and blue subpixels that are arranged in a Rainbow manner, wherein the display panel further comprises a source driver connected with data lines of the display panel, wherein the source driver comprises:

a confirmation unit configured for confirming a received image to be displayed as a preset pure-coloured image, in which the grayscale values that the green subpixels correspond to are within a preset range whereas the grayscale values that the red subpixels and the blue subpixels correspond to are respectively located at different sides beyond the preset range;

a comparison unit configured for comparing the grayscale value that the green subpixel corresponds to with that of the red subpixel or the blue subpixel at a place corresponding to the green subpixel in a previous row to find out the difference; and a display unit configured for adjusting the grayscale value of the green subpixel for displaying based on the difference, wherein the step of adjusting comprises subtracting a preset value from the grayscale value that the green subpixel corresponds to when the difference is less than 0; or the step of adjusting comprises adding a preset value to the grayscale value that the green subpixel corresponds to when the difference is greater than 0.

* * * * *